US006377775B1

(12) United States Patent
Nakayama et al.

(10) Patent No.: US 6,377,775 B1
(45) Date of Patent: Apr. 23, 2002

(54) IMAGE HEATING APPARATUS

(75) Inventors: Toshinori Nakayama, Shizuoka-ken; Osamu Watanabe, Yokohama, both of (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 09/547,344

(22) Filed: Apr. 11, 2000

(30) Foreign Application Priority Data

Apr. 15, 1999 (JP) ..... 11-107756
Mar. 31, 2000 (JP) ..... 2000-099076

(51) Int. Cl.[7] ..... G03G 15/20
(52) U.S. Cl. ..... 399/328; 219/216; 399/334
(58) Field of Search ..... 399/328, 67, 68, 399/69, 330, 331, 334; 219/216, 469, 619, 670, 671

(56) References Cited

U.S. PATENT DOCUMENTS 5,526,103 A * 6/1996 Kato et al. ..... 399/328
5,530,556 A 6/1996 Miura et al. ..... 358/300
5,752,150 A 5/1998 Kato et al. ..... 399/330
5,919,388 A * 7/1999 Kawano et al. ..... 216/670 X
6,037,576 A * 3/2000 Okabayashi et al. .... 399/330 X
6,097,926 A * 8/2000 Takagi et al. ..... 399/328

* cited by examiner

*Primary Examiner*—Sophia S. Chen
*Assistant Examiner*—Hoan Tran
(74) *Attorney, Agent, or Firm*—Fitzpatrick, Cella, Harper & Scinto

(57) ABSTRACT

The present invention relates to any image heating apparatus which has a heating member and a coil for generating magnetic flux, and an eddy current is generated in the heating member by the magnetic flux generated by the coil, the heating member is heated by the eddy current, an image on a recording material is heated by the heat from the heating member, the coil is constituted by a litz wire obtained by twisting a plurality of insulation coated conductive wires, current of 5 Amperes to 50 Amperes are applied to the coil, and an outer diameter of each insulation coated conductive wire is selected to 0.01 mm to 0.4 mm.

17 Claims, 6 Drawing Sheets

IMAGE HEATING APPARATUS

BACKGROUND OF THE INVENTION

1. Field of the Invention

The present invention relates to an image heating apparatus applied to an image forming apparatus such as a copying machine, a printer and the like, and more particularly, it relates to an apparatus for heating an image by induction heating and a coil used in such an apparatus.

2. Related Background Art

Conventionally, in image forming apparatuses of electrophotographic type such as copying machines, printers, facsimiles and the like, there have been proposed various fixing apparatuses (fixing devices) as image heating apparatuses for thermally fixing an unfixed (non-fixed) image (toner image) formed and born on a recording material (for example, a transfer material sheet, a photosensitive paper, an electrostatic recording paper, a printing paper, an OHP sheet and the like) by an appropriate image forming process onto the recording material as a permanently fixed image. Among them, there is an apparatus of induction heating type.

The induction heating apparatus comprises a heating member for generating heat by induction current, and an induction coil (electromagnetic induction heating coil or exciting coil) for generating (by high frequency) magnetic flux to be supplied to the heating member, and the image on the recording material is heated by heat from the heating member.

More specifically, induction magnetic flux is generated by the induction coil, and induction current is generated, by the induction magnetic flux, on an inner surface of a metal core of a fixing roller (heating roller) as the heating member, thereby generating heat required for the fixing by Joule heat due to the induction current. In general, a coil (induction coil) obtained by helically winding a conductive wire is disposed within an inner space of a conductive cylindrical roller as the fixing roller, and, by flowing high frequency current through the coil, eddy current is generated on the fixing roller, thereby directly heating the fixing roller.

However, in such a fixing apparatus of induction heating type, since the high frequency current flows through the induction coil, the current flows along only the surface of the conductive wire due to skin effect. Thus, an electric resistance value in this case greatly differs from a direct current resistance value, with the result that self-heating of the induction coil is generated. In this case, if a heat generating amount is great, the coil is thermally deteriorated, thereby shortening the service life of the coil itself or worsening insulation property of the coil. Particularly, when large current from several A (amperes) to several tens of A flows through the coil, if the resistance value is great, a problem regarding temperature increase due to Joule heat of the coil itself becomes serious, and, when the induction coil is disposed within the inner space of the heating member such as the conductive cylindrical roller, since it is difficult to achieve efficient heat discharge, temperature increase of the coil becomes more serious.

Further, since magnetic core loss of a core (magnetic core) having high permeability and constituting magnetic field generating means by combining with the induction coil tends to be varied with temperature, in the image heating operation, if great temperature increase occurs to increase the magnetic core loss of the core, the heating efficiency will be reduced. If the temperature of the core is equal to or more than Curie temperature, magnetism will disappear, with the result that not only adequate heating cannot be achieved but also great load will act on an exciting circuit for supplying exciting voltage to the induction coil.

As a method for solving this problem, although it is considered that the number of wires (strands) of a litz wire is increased, in such a case, the weight of the apparatus is increased accordingly, and the cost of the induction coil is increased accordingly. Further, it is technically difficult to form an induction coil which can be contained within the small inner space of the heating member.

SUMMARY OF THE INVENTION

An object of the present invention is to provide an image heating coil and an image heating apparatus, which can prevent increase in temperature of the coil without increasing the number of the windings of the coil.

Another object of the present invention is to provide an image heating apparatus comprising a heating member and a coil for generating magnetic flux, wherein eddy current is generated in the heating member by the magnetic flux generated by the coil, the heating member is heated by the eddy current, an image on a recording material is heated by the heat from the heating member, the coil is constituted by a litz wire obtained by twisting a plurality of insulation coated conductive wires, current of 5 to 50 Amperes are applied to the coil, and an outer diameter of each insulation coated conductive wire is selected to 0.01 to 0.4 mm.

A further object of the present invention is to provide an image heating coil comprising a plurality of insulation coated conductive wires, wherein the coil is constituted by a litz wire obtained by twisting the plurality of insulation coated conductive wires, current of 5 to 50 Amperes are applied to the coil, and an outer diameter of each insulation coated conductive wire is selected to 0.01 to 0.4 mm.

A still further object of the present invention is to provide an image heating apparatus comprising a heating member and a coil for generating magnetic flux, wherein an eddy current is generated in the heating member by the magnetic flux generated by the coil, the heating member is heated by the eddy current, an image on a recording material is heated by the heat from the heating member, the coil is constituted by a litz wire obtained by twisting a plurality of insulation coated conductive wires, the number of windings of the coil is 4 to 15 (turns), and an outer diameter of each insulation coated conductive wire is selected to 0.01 to 0.4 mm.

A further object of the present invention is to provide an image heating coil comprising a plurality of insulation coated conductive wires, wherein the coil is constituted by a litz wire obtained by twisting the plurality of insulation coated conductive wires, the number of windings of the coil is 4 to 15 (turns), and an outer diameter of each insulation coated conductive wire is selected to 0.01 to 0.4 mm.

The other objects and features of the present invention will be apparent from the following detailed explanation referring to the accompanying drawings.

DESCRIPTION OF THE PREFERRED EMBODIMENTS

The present invention will now be explained in connection with embodiments thereof with reference to the accompanying drawings.

FIRST EMBODIMENT

Figure 1:
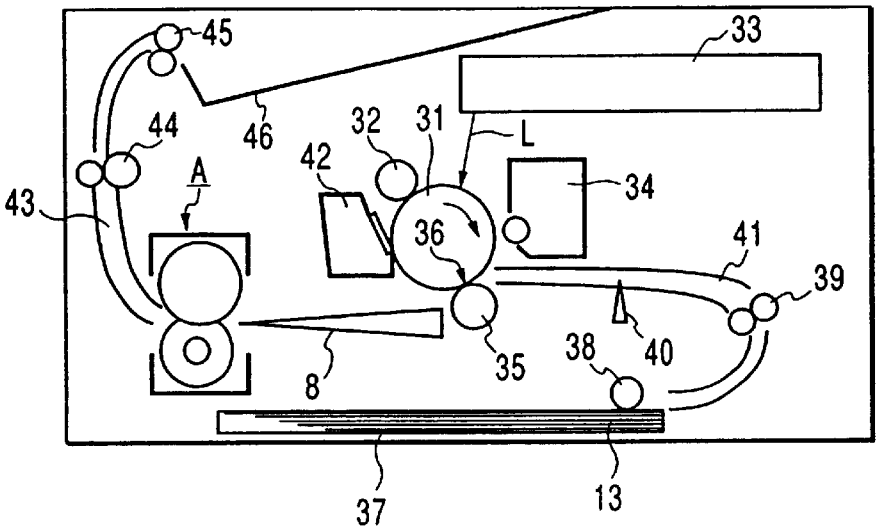
FIG. 1 is a view showing an image forming apparatus to which an image heating apparatus according to an embodiment of the present invention can be applied.

FIG. 1 is a schematic constructural view of an image forming apparatus according to a first embodiment of the present invention. The image forming apparatus according to this embodiment is a laser printer using a transfer electrophotographic process and having a fixing apparatus of induction heating type.

A rotatable drum-shaped electrophotographic photosensitive member (referred to as "photosensitive drum" hereinafter) 31 as an image bearing member is rotated in a clockwise direction shown by the arrow at a predetermined peripheral speed (process speed).

During rotation, the photosensitive drum 31 is uniformly charged with predetermined polarity and potential by means of a charging roller (charging device) 32.

Then, the photosensitive drum is subjected to laser beam scan exposure L corresponding to a target image information pattern performed by a laser scanner (image information writing means) 33. As a result, an electrostatic latent image corresponding to the target image information is formed on the surface of the photosensitive drum 31.

The electrostatic latent image formed on the surface of the photosensitive drum 31 is developed as a toner image by a developing device 34. As a developing method, a jumping developing method or a two-component developing method or the like is used, and combination of image exposure and reversal developing is mainly utilized.

At a transfer-nip portion 36 defined between the photosensitive drum 31 and a transfer roller 35, the toner images formed on the surface of the photosensitive drum 31 are successively transferred onto a recording material (transfer material) 13 fed from a sheet feeding portion 37 to the transfer nip portion 36 at a predetermined control timing. The toner image on the photosensitive drum 31 is electrostatically transferred onto the recording material 13 by applying voltage having polarity opposite to charging polarity of the toner to the transfer roller 35.

In the image forming apparatus according to the illustrated embodiment, the sheet feeding portion 37 is a cassette sheet feeding portion in which the recording materials 13 contained in a sheet feeding cassette are separated and picked up one by one by means of a sheet feeding roller 38 and a one-sheet separating member (not shown), and the separated recording material is fed to the transfer nip portion 36 at the predetermined control timing through a sheet path 41 including a pair of conveying rollers 39, a top sensor (registration sensor) 40 and the like.

A leading end of the recording material 13 supplied from the cassette sheet feeding portion 37 and fed to the transfer nip portion 36 through the sheet path 41 is detected by the top sensor 40 provided on the way of the sheet path 41, and, in synchronous with this, the image is formed on the photosensitive drum 31.

The recording material to which the toner image was transferred at the transfer nip portion 36 is separated from the surface of the photosensitive drum 31 and is introduced, through a convey guide 8, into a fixing apparatus A, where an unfixed toner image is subjected to thermal fixing process.

After the recording material leaves the fixing apparatus A, the recording material 13 is passed through a sheet path 43 including a pair of conveying rollers 44 and is discharged onto a discharge tray portion 46 by means of a pair of discharge rollers 45.

On the other hand, after the toner image is transferred to the recording material 13, contaminants such as transfer residual toner and paper powder remaining on the surface of the photosensitive drum 31 are removed from the surface of the photosensitive drum 31 by means of a cleaner 42, so that the cleaned photosensitive drum 31 can be used for next image formation.

Figure 2:
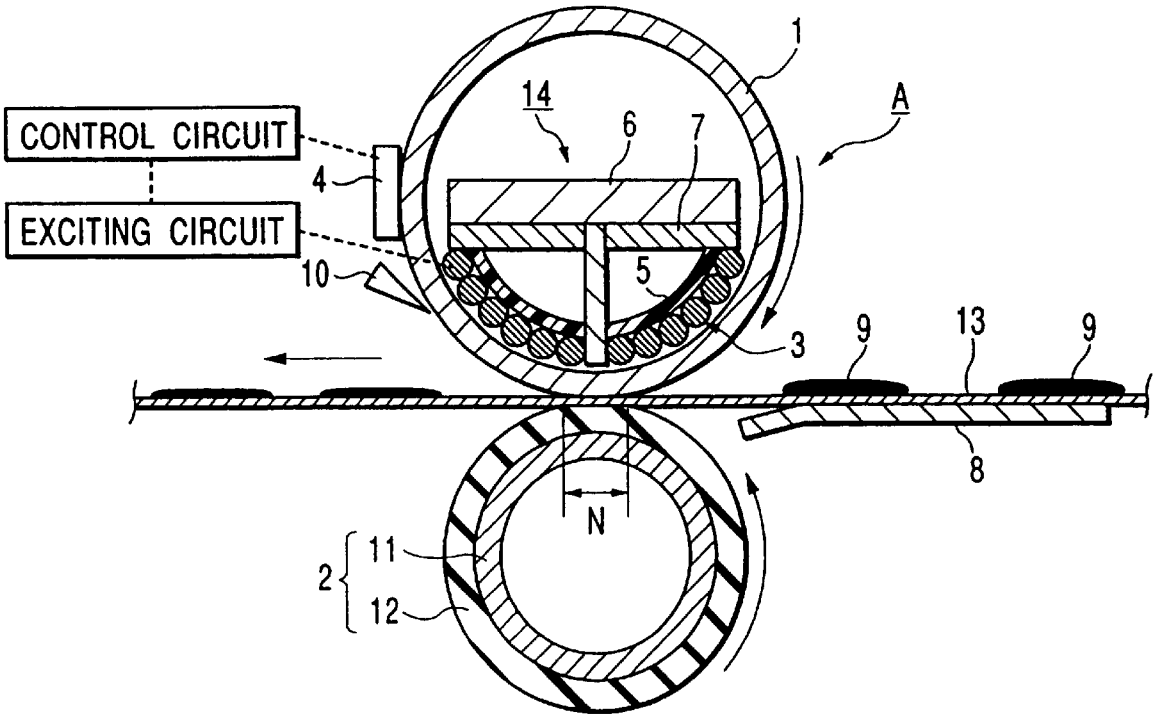
FIG. 2 is a view of the image forming apparatus according to the embodiment of the present invention.

FIG. 2 is a schematic cross-sectional view showing main portions of the fixing apparatus A as an image heating apparatus. The fixing apparatus includes a fixing roller (heat roller) 1 as a heating member, and a pressure roller 2 as a pressing member.

The fixing roller 1 is formed from conductive material which generates heat by induction current. In the illustrated embodiment, the fixing roller has a core metal cylinder (conductive cylindrical roller) made of iron and having an outer diameter of 40 mm and a thickness of 0.7 mm as a substrate, and, in order to enhance surface mold releasing ability, for example, a surface mold releasing layer made of PTFE or PFA and having a thickness of 10 to 50 $\mu$m may be provided. Further, in order to enhance fixing ability and/or to reduce unevenness in temperature on the roller surface, for example, an elastic layer made of silicone rubber and having a thickness of 20 to 500 $\mu$m may be provided between the iron core metal cylinder and the surface mold releasing layer.

The pressure roller 2 includes a hollow metal core 11, and an elastic layer 12 which is a surface mold releasing heat-resistive rubber layer formed on an outer peripheral surface of the metal core or a sponge layer acting to achieve thermal insulation between the hollow metal core 11 and the surface.

The fixing roller 1 and the pressure roller 2 are assembled between fixing unit frames (not shown) in such a manner that the fixing roller 1 is disposed above the pressure roller 2 in parallel with each other and both ends of these rollers are rotatably supported by the frames via bearings.

The pressure roller 2 is urged against a lower part of the fixing roller 1 with predetermined pressure by means of a pressing mechanism (not shown) such as a spring, thereby defining a fixing nip portion (pressure nip portion) N therebetween. In the illustrated embodiment, the pressure roller 2 is biased with about 30 Kg-weight (30×9.8=294 N) so that a width of the fixing nip portion N (nip width) becomes about 6 mm. However, if necessary, the nip width may be changed by changing the load.

In the illustrated embodiment, the fixing roller 1 is rotated by a drive mechanism (not shown), and the pressure roller 2 is rotatingly driven by the rotation of the fixing roller 1 via a friction force at the fixing nip portion N.

An induction coil assembly 14 is inserted into and arranged within an inner space of the fixing roller 1 and comprises an induction coil 3, a coil holder 5, a magnetic core (magnetic member) 7 and a stay 6.

The coil holder 5 is a bucket-shaped member having semi-circular cross-section and made of heat-resistive resin such as PPS, PEEK or phenol resin, and the induction coil 3 is formed by winding conductive wire around the coil holder 5. The core 7 is assembled to have T-shaped cross-section within the coil holder 5. The induction coil 3, coil holder 5, core 7 and stay 6 may be tightly coated by heat-shrinkable tube, thereby forming the induction coil assembly.

The induction coil assembly 14 is disposed within the inner space of the fixing roller 1 by inserting the induction coil assembly 14 into the inner space of the fixing roller 1 and by securing both ends of the stay 6 between the fixing unit frames (not shown) in a condition that the induction coil 3 on the coil holder is directed downwardly and is adjacent to the inner surface of the fixing roller 1.

A temperature sensor 4 such as a thermistor is contacted with the surface of the fixing roller 1.

A separating claw (pawl) 10 is disposed in contact with or closely adjacent to the surface of the fixing roller 1 at a recording material outlet side of the fixing nip portion N.

In a condition that the fixing roller 1 is rotated and the pressure roller 2 is rotatingly driven, alternate current having high frequency is applied to the induction coil from an exciting circuit. The exciting circuit serves to generate high frequency of 10 to 100 kHz by a switching power supply. By the alternate current having high frequency supplied from the exciting circuit, alternating magnetic flux is generated in the induction coil 3. The magnetic field induced by the alternate current flows eddy current along the inner surface (conductive layer) of the fixing roller 1 to generate Joule heat, with the result that the fixing roller 1 is efficiently heated quickly.

Regarding the high frequency, if the frequency is smaller than 10 kHz, the frequency is overlapped with the human's audible band, thereby generating noise or sound. On the other hand, if the frequency is greater than 100 kHz, the power supply will be damaged.

The temperature of the fixing roller 1 is detected by the temperature sensor 4, and a detection temperature signal is inputted to a control circuit. The control circuit automatically controls magnitude of electric power supplied from the exciting circuit to the induction coil 3 on the basis of the detection temperature signal so that the surface temperature of the fixing roller 1 is maintained to predetermined constant temperature (predetermined fixing temperature).

In a condition that the surface temperature of the fixing roller 1 is automatically controlled to the predetermined constant temperature, when the recording material 13 bearing a non-fixed toner image 9 is introduced into the fixing nip portion N, pinched and conveyed, the non-fixed toner image 9 is thermally fixed to the surface of the recording material 13 by the heat from the fixing roller 1.

In order to increase the heat amount of the fixing roller 1, the number of windings (turns) of the induction coil 3 may be increased, or the core 7 may be formed from material having high permeability and low residual magnetic flux density such as ferrite or permalloy, or the frequency of the alternate current may be increased.

The induction coil 3 used in the illustrated embodiment is formed by six turns (windings) of a litz wire obtained by twisting 50 to 150 wires. Although the windings is preferably 4 to 10 turns, about 4 to 15 turns do not arise a practical problem. If the number of turns of the coil is greater than 15, it is not preferable in the light of the productivity and the cost of the coil.

Figure 3A:
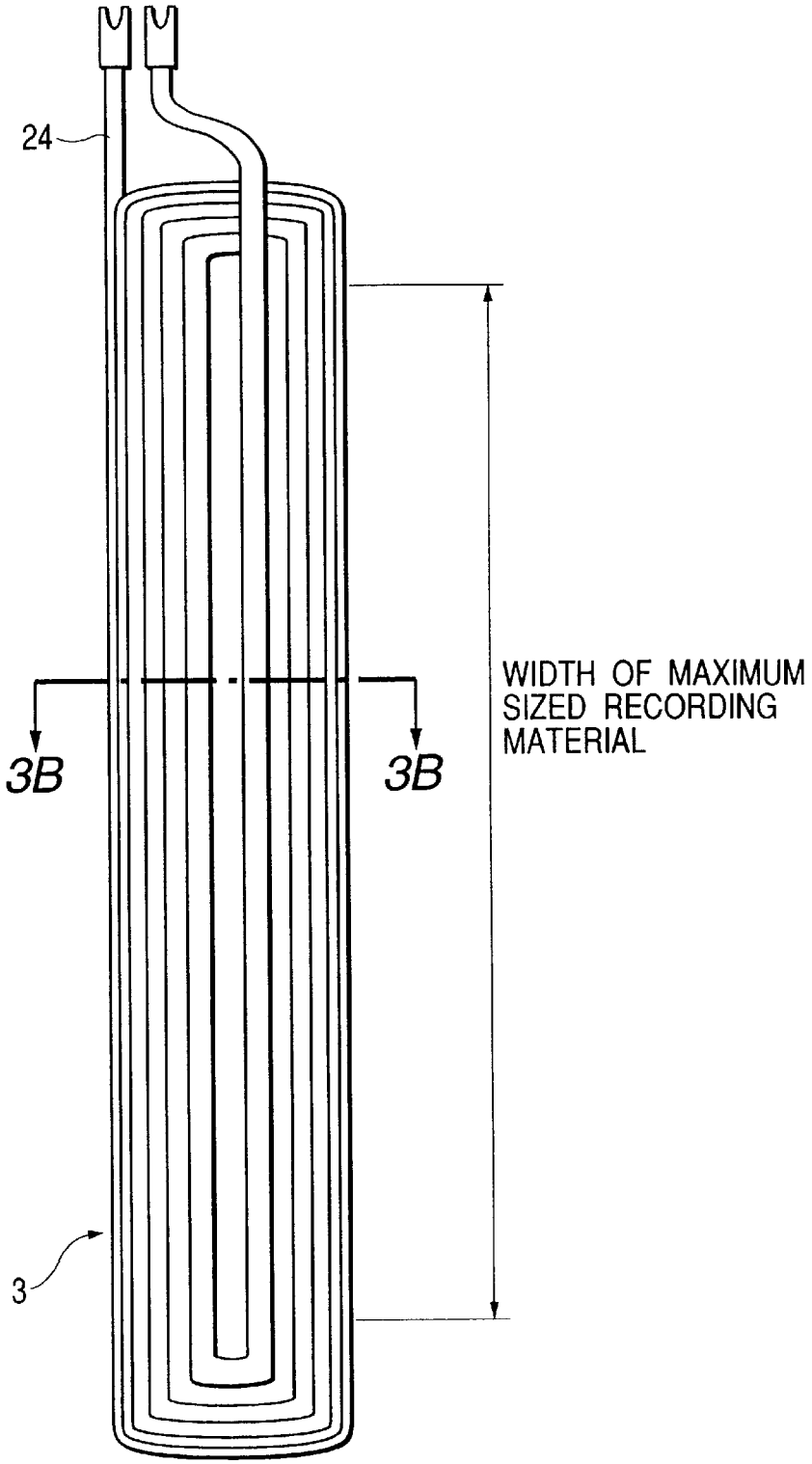
FIGS. 3A and 3B are views showing a coil.
Figure 3B:
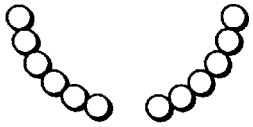

FIG. 3A is a view showing how to wind the coil, and FIG. 3B is a sectional view taken along the line 3B—3B in FIG. 3A. The coil extends toward a direction perpendicular to a recording material shifting direction and has a length greater than a maximum size recording material.

Figure 4A:
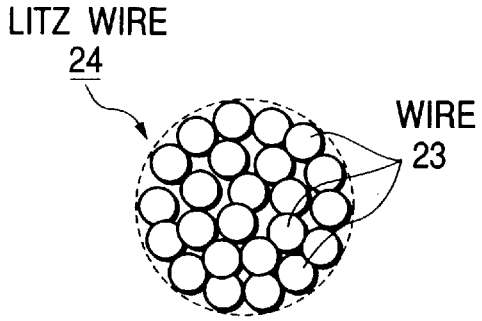
FIG. 4A is a view showing a litz wire.
Figure 4B:
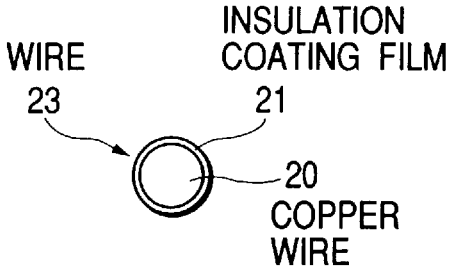
FIG. 4B is a view showing a wire constituting the litz wire.

FIG. 4A is a schematic sectional view of the litz wire 24 obtained by twisting a plurality of wires 23 together. As shown in FIG. 4B (sectional view), each wire 23 is constituted by an electrically conductive wire 20 (such as copper), and an electrically insulation coating 21 such as enamel, PIW (polyimide) or AIW (polyamide imide) coated on the conductive wire so that, even when the wires 23 are contacted with each other, there is no electrical communication between the wires. The coil is obtained by winding the litz wire.

Since the alternate current having high frequency (10 to 100 kHz) is applied to the induction coil 3, there is a phenomenon in which the greater the diameter of the conductive wire the greater the actual resistance due to skin effect. Accordingly, as the induction coil, it is more preferable that a fine coated conductive wire or a litz wire obtained by bundling a plurality of such fine wires is used than that a single fat coated conductive wire is used.

Figure 5:
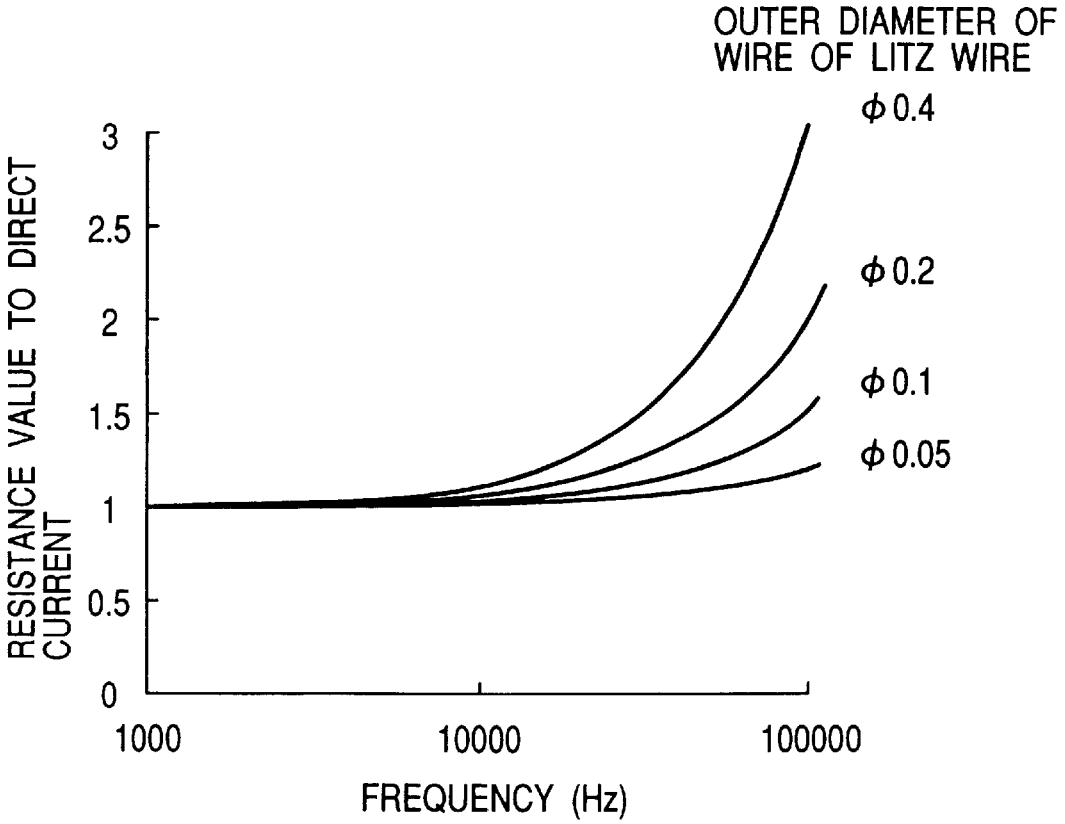
FIG. 5 is a graph showing a relationship between frequency and resistance.

FIG. 5 is a graph showing a relationship between frequency and specific resistance value to direct current when the total cross-sectional area of the litz wire is constant and diameters of the wires are changed. In order to maintain the total cross-sectional area of the litz wire, when fine wires are used, the number of the wires is increased.

According to FIG. 5, since the total cross-sectional area is the same, the resistance value to the direct current at a low frequency region is the same for any litz wires; however, at a high frequency region, it can be seen that the greater the diameter of the litz wire the greater the resistance value.

Since the fact that the resistance value is increased means that self-heat generating amount of the induction coil is increased accordingly, it is desirable that diameters of the wires used in the litz wire be smaller as less as possible. However, in consideration of endurance, cost and productivity of the wires, wires having diameters smaller than 0.01 mm are not practical. That is to say, regarding an outer diameter of an insulation coated conductive wire, it is technically difficult to form a wire having an outer diameter smaller than 0.01 mm, and the manufacturing cost is also increased, and, thus, such a wire is not practical. A wire having an outer diameter greater than 0.4 mm generates great electrical loss due to skin effect and increases the temperature of the coil excessively, and, thus, such a wire is not preferable. For example, heat-resistance standard of AIW (polyamide imide) used as the insulation coating for the litz wire is defined as continuous use at a temperature of 220° C. or less. However, if the outer diameter is greater than 0.4 mm, the temperature of the coil will apt to exceed 220° C.

In consideration of manufacturing ability, endurance and temperature increase, it is preferable that the outer diameter of the wire is greater than 0.1 mm and smaller than 0.2 mm.

Regarding induction coils 3 constituted by litz wires 24 (having constant total cross-sectional area) using constructural wires 23 having outer diameter of 0.05 mm, 0.1 mm, 0.2 mm and 0.4 mm, respectively, results of tests in which temperatures of coils were measured when the recording materials 13 were passed through the fixing apparatus A at a rate of one sheet per 10 seconds are shown in the following Table 1. As the test conditions, the passing speed of the recording material 13 was set to 50 mm/sec and the temperature adjusted surface temperature of the fixing roller 1 was selected to 160° C. From the test results, it can be seen the effect for reducing the diameter of the wire 23.

TABLE 1

| wire outer diameter (mm) | φ0.05 | φ0.1 | φ0.2 | φ0.4 |
|---|---|---|---|---|
| coil temperature (° C.) | 168 | 174 | 184 | 203 |

In the illustrated embodiment, average current value (effective value) flowing through the induction coil during sheet passing is equal to or greater than 5 A (amperes) and equal to or smaller than 50 A. Since an electric power required for maintaining the temperature during the continuous sheet passing is substantially proportional to an average current value and the number of turns (windings) of the coil in accordance with an ampere-turn low, if the average current value is smaller than 5 A, the number of turns of the coil is naturally increased, with the result that the manufacturing ability for the coil unit is worsened and the manufacturing cost is increased. Further, if the current value is greater than 50 A, since the number of turns of the coil can be reduced, the above problems can be solved; however, the increase in the current value is not preferable since the self-heating amount of the coil is increased.

In this way, according to the illustrated embodiment, by using the litz wire obtained by bundling the plurality of insulation coated conductive wires each having the outer diameter of 0.01 to 0.4 mm as the insulation coated conductive wire constituting the induction coil, since the surface area of the conductive wire can be increased while maintaining the total cross-sectional area of the litz wire to constant, even when the high frequency current is applied, excessive temperature increase due to self-heating of the induction coil can be suppressed and a light-weighted, compact and cheap induction coil can be provided.

Further, by properly determining the current value applied to the coil, the coil can be further made compact without excessive temperature increase of the coil.

SECOND EMBODIMENT

Figure 6:
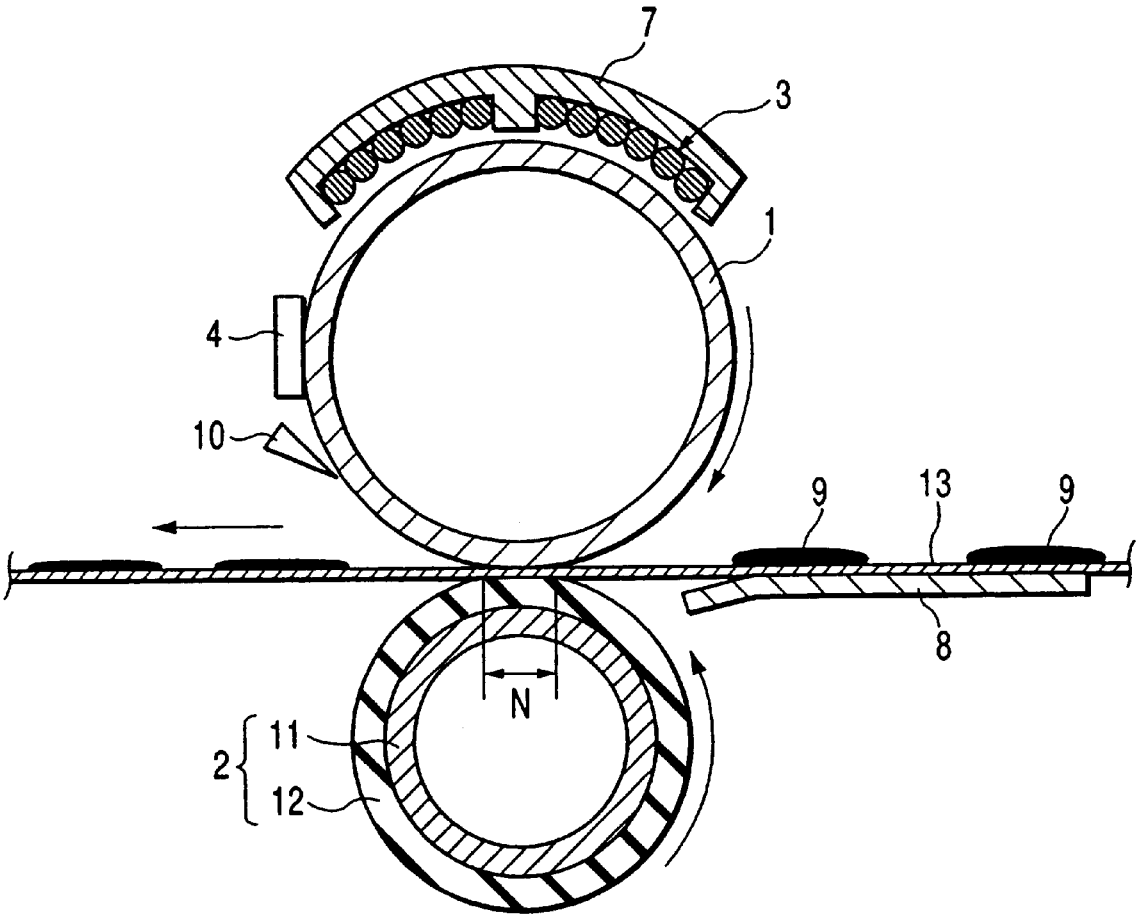
FIG. 6 is a view showing an image heating apparatus according to another embodiment of the present invention.

In a second embodiment of the present invention, as shown in FIG. 6, the induction coil 3 and the core 7 are disposed outside of the fixing roller 1. The other arrangements are the same as those in the fixing apparatus according to the first embodiment.

The effect obtained by the second embodiment is that, since the induction coil 3 is disposed outside of the fixing roller, the heat of the induction coil 3 can be discharged to the outside. As a result, much electric power can be applied to the fixing apparatus A, and, thus, the fixing apparatus can be applied to office equipments capable of obtaining a larger number of copies.

THIRD EMBODIMENT

Figure 7:
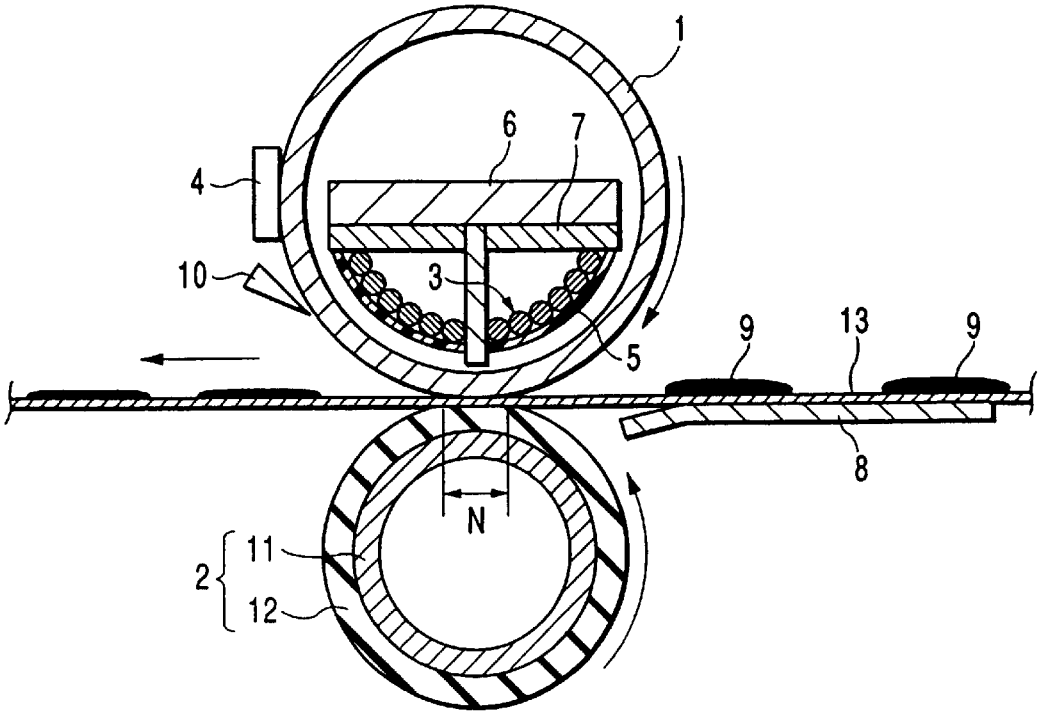
FIG. 7 is a view showing an image heating apparatus according to further embodiment of the present invention.
Figure 8:
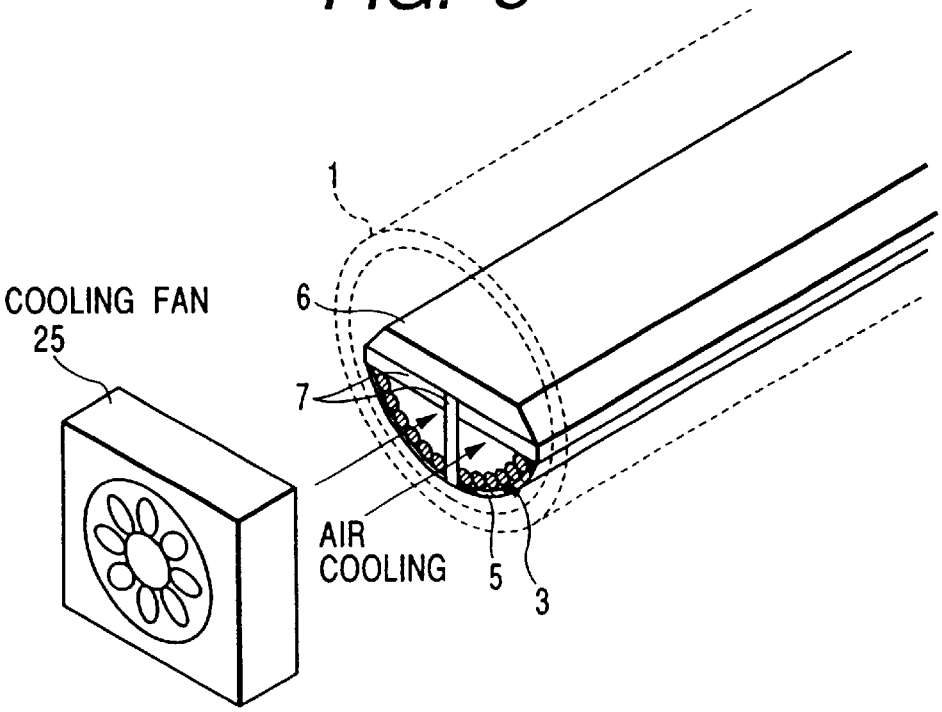
FIG. 8 is a view showing a cooled condition of the apparatus of FIG. 7.

According to a third embodiment of the present invention, in the fixing apparatus A of the first embodiment, as shown in FIGS. 7 and 8, the induction coil 3 is disposed within the coil holder 5 and the induction coil 3 is cooled by sending cooling air into the inner space of the coil holder 5 by means of a cooling fan 25.

Due to cooling effect for the induction coil, the present invention can be applied to a fixing apparatus of a color copying machine which requires much electric power for the fixing apparatus or a high speed copying machine capable of obtaining a larger number of copies.

FOURTH EMBODIMENT

Figure 9:
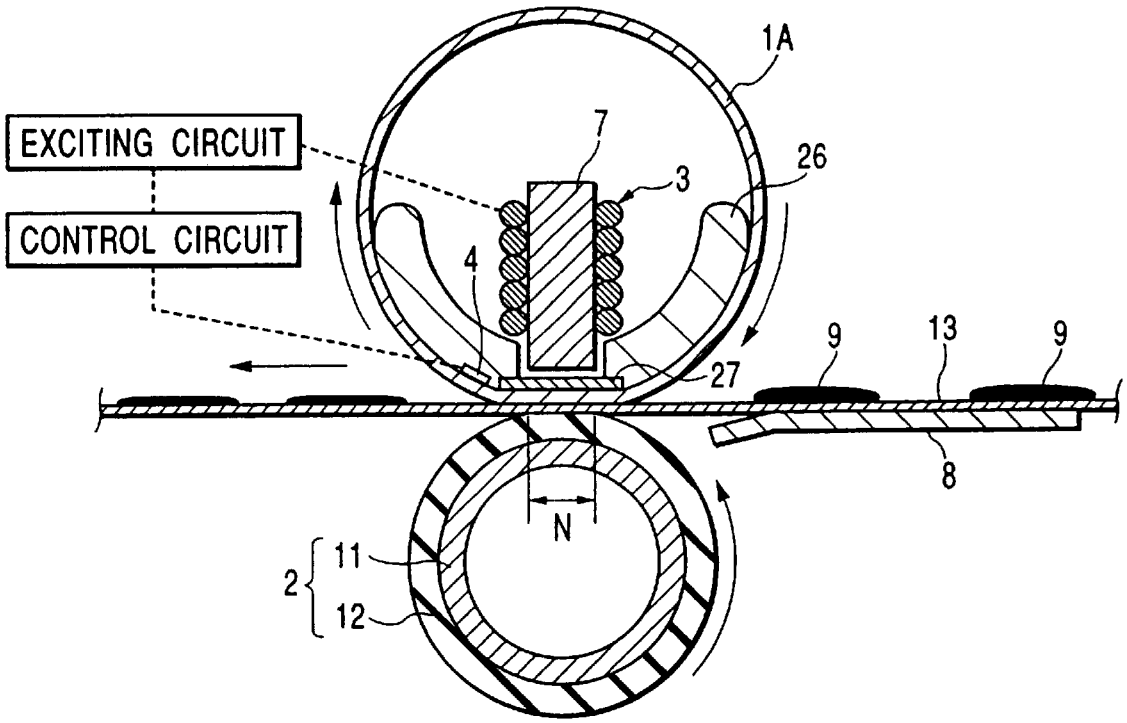
FIG. 9 is a view showing an image heating apparatus according to a still further embodiment of the present invention.

A fourth embodiment of the present invention relates to a fixing apparatus of induction heating and pressure roller driving type. In FIG. 9, the fixing apparatus includes a cylindrical induction heating belt (referred to as "fixing belt" hereinafter) 1A. For example, the fixing-belt 1A has a thin wall multi-layer structure including a metal (for example, nickel, iron, ferromagnetic SUS or nickel/cobalt alloy) belt layer (having a thickness of 1 to 100 μm), an elastic layer laminated on an outer surface of the metal belt layer, and a mold releasing layer laminated on an outer surface of the elastic layer. The fixing belt is externally coupled around belt guides 26.

A slip plate 27 is disposed at a lower part of the belt guides 26, and a pressure roller 2 is urged against the slip plate 27 with the interposition of the induction heating belt 1A, thereby defining a fixing nip portion N between the belt 1A and the pressure roller.

An induction coil 3 wound around a core 7 is disposed an inner space defined by the belt guides 26. In this case, the core 7 is opposed to the slip plate 27 so that the magnetic flux generated by the induction coil 3 is concentrated into the fixing nip portion N. The construction of the coil, current applied to the coil and frequency of the current are the same as those in the first embodiment.

A temperature sensor 4 is disposed in contact with an outer surface of the belt guide at a downstream side of the fixing nip portion M in a rotational direction of the fixing belt.

In the apparatus according to the illustrated embodiment, the pressure roller 2 is rotated in an anti-clockwise direction shown by the arrow by a drive mechanism (not shown). When the pressure roller 2 is rotated, the cylindrical fixing belt 1A is rotatingly driven in a clockwise direction shown by the arrow around the belt guides 26 while sliding on the slip plate 27 by a friction force between the pressure roller 2 and the belt 1A at the fixing nip portion N.

Further, by applying alternate current having high frequency to the induction coil 3 from an exciting circuit, since magnetic flux generated by the induction coil 3 is concentrated and acts on the fixing nip portion N, at the fixing nip portion N, the metal belt layer of the fixing belt 1A is mainly heated by induction, thereby heating the fixing nip portion N. In a condition that the temperature of the fixing nip portion N is increased to a predetermined fixing temperature and such a temperature is temperature-adjusted by the temperature sensor 4 and a control circuit, while the recording material 13 bearing the unfixed toner image 9 is being passed between the fixing belt 1A and the pressure roller 2 at the fixing nip portion N, the unfixed toner image 9 is thermally fixed onto the surface of the recording material 13.

Incidentally, in the above-mentioned apparatus, the slip plate 27 may be formed from an induction heating member such as an iron plate and the fixing belt 1A may be formed from a thin electrically insulation heat-resistive resin film member.

Further, the pressure roller 2 is not limited to a roller but has other configuration such as a rotatable belt.

Further, heating means such as electromagnetic induction heating means may be provided at a side of the pressure roller 2 so as to also supply heat to the recording material 13 from the side of the pressure roller 2, thereby heating and temperature-adjusting to the predetermined temperature.

In addition, the image heating apparatus according to the present invention can be embodied not only as the image heating fixing apparatuses shown in the above-mentioned embodiments, but also as an image heating apparatus for improving a surface property (such as gloss) of the recording material by heating the recording material bearing the image and as an image heating apparatus for effecting temporary fixing.

Further, principle and process for forming the image on the recording material 13 is not limited to the electrophotographic process, but, an electrostatic process or a magnetic recording process of direct type or transfer type can be used.

While the present invention has been explained with reference to the preferred embodiments, the present invention is not limited to such embodiments, and various alterations can be made within the scope of the invention.

What is claimed is:

1. An image heating apparatus comprising:

a heating member; and a coil for generating magnetic flux;

wherein an eddy current is generated in said heating member by the magnetic flux generated by said coil, said heating member is heated by the eddy current, and an image on a recording material is heated by the heat from said heating member;

wherein said coil is constituted by a litz wire in which 50 to 150 pieces of insulation coated conductive wires having an outer diameter of 0.01 mm to 0.4 mm are twined.

2. An image heating apparatus according to claim 1, the outer diameter of each insulation coated conductive wire is preferably larger than 0.1 mm and smaller than 0.2 mm.

3. An image heating apparatus according to claim 1, wherein frequency of a current applied to said coil is 10 kHz to 100 kHz.

4. An image heating apparatus according to claim 1, wherein said heating member includes a roller.

5. An image heating apparatus according to claim 1, wherein said heating member includes an endless film.

6. An image heating apparatus according to claim 1, wherein an unfixed image is fixed onto the recording material by the heat from said heating member.

7. A coil used for an image heating apparatus, comprising:

a litz wire obtained by twisting a plurality of insulation coated conductive wires;

wherein said litz wire is constituted by a litz wire in which 50 to 150 pieces of insulation coated conductive wires having an outer diameter of 0.01 mm to 0.4 mm are twined.

8. A coil according to claim 7, the outer diameter of each insulation coated conductive wire preferably larger than 0.1 mm and smaller than 0.2 mm.

9. A coil according to claim 7, wherein frequency of a current applied to said coil is 10 kHz to 100 kHz.

10. An image heating apparatus comprising:

a heating member;

a coil for generating magnetic flux, wherein an eddy current is generated in said heating member by the magnetic flux generated by said coil, said heating member is heated by the eddy current, and an image on a recording material is heated by the heat from said heating member, wherein said coil is constituted by a litz wire obtained by twisting a plurality of insulation coated conductive wires, and the number of windings of said coil is 4 to 15 turns; and control means for controlling a current applied to said coil so that a temperature of said heating member is maintained at a predetermined temperature during an image heating operation, wherein a current of 5 Amperes to 50 Amperes are applied to said coil during the image heating operation.

11. An image heating apparatus according to claim 10, wherein the number of windings of said coil is 4 turns to 10 turns.

12. An image heating apparatus according to claim 10, wherein said coil is wound along a direction perpendicular to a moving direction of the recording material.

13. An image heating apparatus according to claim 10, further comprising a core extending in a direction perpendicular to the moving direction of the recording material for guiding the magnetic flux, wherein said coil is wound around said core.

14. An image heating apparatus according to claim 10, wherein frequency of a current applied to said coil 10 kHz to 100 kHz.

15. An image heating apparatus according to claim 10, wherein said heating member includes a roller.

16. An image heating apparatus according to claim 10, wherein said heating member includes an endless film.

17. An image heating apparatus according to claim 10, wherein an unfixed image is fixed onto the recording material by the heat from said heating member.

* * * * *

UNITED STATES PATENT AND TRADEMARK OFFICE

CERTIFICATE OF CORRECTION

PATENT NO. : 6,377,775 B1
DATED : April 23, 2002
INVENTOR(S) : Toshinori Nakayama et al.

It is certified that error appears in the above-identified patent and that said Letters Patent is hereby corrected as shown below:

Column 1,
Line 17, “born” should read -- borne --.

Column 2,
Line 25, “are” should read -- is --.

Column 6,
Line 1, “is” should read -- are --.
Line 15, “electrically” should read -- electrical --.
Line 59, “apt” should read -- be apt --.

Column 7,
Line 18, “an” should read -- the --.
Line 37, “to” should be deleted.

Column 9,
Line 32, “the” should read -- wherein the --.

Column 10,
Line 1, “the” should read -- wherein the --.
Line 2, “wire” should read -- wire is --.
Line 24, “are” should read -- is --.

Signed and Sealed this

Twenty-fourth Day of September, 2002

*Attest:*

*Attesting Officer*

JAMES E. ROGAN
*Director of the United States Patent and Trademark Office*